US005137260A

United States Patent [19]

Pehr

[11] Patent Number: 5,137,260

[45] Date of Patent: * Aug. 11, 1992

[54] CHILD RESISTANT CONTAINER WITH FLUSH LATCHED CLOSURE

[76] Inventor: Harold T. Pehr, 3920 W. 96th St., Shawnee Mission, Kans. 66207

[ * ] Notice: The portion of the term of this patent subsequent to May 15, 2007 has been disclaimed.

[21] Appl. No.: 365,518

[22] Filed: Jun. 13, 1989

Related U.S. Application Data

[63] Continuation-in-part of Ser. No. 277,228, Nov. 29, 1988, Pat. No. 4,925,041, which is a continuation of Ser. No. 160,571, Feb. 26, 1988, Pat. No. 4,787,526.

[51] Int. Cl.[5] ..... B65D 55/02

[52] U.S. Cl. ..... 215/216; 215/237; 220/326

[58] Field of Search ..... 215/216, 225, 235, 237, 215/238, 245; 222/153

[56] References Cited

U.S. PATENT DOCUMENTS

| | | | |
|---|---|---|---|
| Re. 29,793 | 10/1978 | Pehr . | |
| 351,769 | 11/1971 | Hentschke et al. . | |
| 3,623,622 | 11/1971 | Sullivan . | |
| 3,790,015 | 2/1974 | Imamura . | |
| 3,826,394 | 7/1974 | Stull . | |
| 3,830,391 | 8/1974 | Uhlig . | |
| 3,830,393 | 8/1974 | Schaefer . | |
| 3,871,662 | 3/1975 | Happ et al. . | |
| 3,894,647 | 7/1975 | Montgomery . | |
| 4,127,221 | 11/1978 | Vera . | |
| 4,170,315 | 10/1979 | Dubach et al. . | |
| 4,244,495 | 1/1981 | Lorschied et al. . | |
| 4,353,483 | 10/1982 | Pehr . | |
| 4,424,910 | 1/1984 | Heinol . | |
| 4,629,081 | 12/1986 | McLaren . | |
| 4,787,526 | 11/1988 | Pehr | 215/216 |
| 4,925,041 | 5/1990 | Pehr | 215/216 |

*Primary Examiner*—Stephen Marcus
*Assistant Examiner*—Nova Stucker
*Attorney, Agent, or Firm*—Litman, McMahon & Brown

[57] ABSTRACT

A child resistant container with a flush latched closure includes a container with a resilient latch tongue member hinged thereto, the tongue including upper and lower pawls forming a latch recess therebetween. A closure or cap is hinged to the container and includes a latch bar sized and shaped to be flushly received within the latch recess to prevent gripping access to the latch bar. The cap hinge is of such a configuration that the cap cannot be separated from the container body with the cap latched closed. The latch is released by flexing the latch tongue toward the container which moves the upper pawl out of the way of the latch bar and moves the lower pawl beneath the latch bar to expose a gripping edge of the latch bar to allow a fingernail or the like to be used to open the cap. The latch tongue is positionable in such a manner as to avoid use of the latch to close the container, and the cap and container body are cooperatively sized to seal the container without the cap being latched thereto.

20 Claims, 2 Drawing Sheets

CHILD RESISTANT CONTAINER WITH FLUSH LATCHED CLOSURE

CROSS REFERENCE TO RELATED APPLICATIONS

This is a continuation-in-part of application Ser. No. 07/277,228 filed Nov. 29, 1988 for CLOSURE FOR CONTAINER now U.S. Pat. No. 4,925,041 , which is a continuation of application Ser. No. 07/160,571 filed Feb. 26, 1988 for CONTAINER CLOSURE HAVING CHILD PROTECTIVE FASTENING MEANS which issued on Nov. 29, 1988 as U.S. Pat No. 4,787,526, the disclosures of said applications being incorporated herein by reference.

FIELD OF THE INVENTION

The present invention relates to child resistant containers and, more particularly, to such a container having a flush latched hinged closure.

BACKGROUND OF THE INVENTION

For many years, both government and industry standards have been promulgated to reduce accidental poisoning or injury to children by making it relatively difficult for young children to open certain types of containers, for example, pharmacy vials containing drugs. Unfortunately, most of the developments which make containers difficult to open by children also make the containers difficult to open by adults. This is especially true of adults having limited manual dexterity, such as both younger and older adults suffering from arthritis and other diseases or those having injuries which lessen manual dexterity.

Various prior art devices have been developed which attempt to provide both a difficult to open container when the product is being used in the presence of children and an easy open container for persons having limited dexterity. One such device of this type is described in applicant's U.S. Pat. No. 4,353,483 which included a bipositional hinged tab which makes the cap easy to open when in one position and relatively difficult to open in another position.

Unfortunately, the prior art devices have had somewhat mixed success with children, since children can be quite creative in opening containers. This is especially true where a child is willing to use his or her teeth to attempt to open the lid of a container. A child is often able to make up for a lack of manual dexterity or the inability to understand how to open the lid through the strong pressure that can be exerted by the teeth and can often pry the lid open or bite off portions of the latch to allow the lid to open. Certain prior art devices have attempted to circumvent this problem by positioning guard members to keep children's teeth from engaging the lifting tab (for example, see U.S. Pat. No. to Stull No. 3,826,394). However, none of the prior ar devices has highly effectively and inexpensively combined a structure which can be configured for easy opening by adults and yet can be configured to inhibit opening by young children.

It is becoming increasingly evident to product safety specialists that closure members for certain types of containers, especially pharmaceutical vials, should be designed such that the lid once attached to the body is always maintained connected to the body of the container and preferably such that the lid can be closed using a single hand. That is, that a user can both swing the lid into a closed position while holding the vial with the same hand that is being utilized to swing the lid and that the lid will then automatically lock in a secured configuration when the lid is closed. This concept is frequently referred to as "one hand and one motion to close".

It is desirable that the container include a hinge for connecting the lid to the body of the container that is difficult for a child to manipulate and, thereby, open the container by disassembly of the hinge. There is also a need in the industry for the lid to be molded separately from the container and later assembled therewith. This allows one standard size lid to be manufactured for multiple sized containers or vials at a substantial savings in molding expense. For convenience in use, it is desirable that such a hinge hold the lid in at least one predetermined open position so that the lid will not flop freely back into a closed position, thereby making manipulation of the vial difficult.

SUMMARY OF THE INVENTION

The present invention provides a child resistant container which is alternatively configurable to an easy open container for use by an adult. The container includes a hinged latch tongue with upper and lower pawl projections forming a recess across the tongue. A bar on a cap hinged to the container is sized and shaped to fit flushly within the tongue recess to latch the cap to the container. The flush fit of the bar in the recess results in the edge of the bar being inaccessible to prevent prying open the container by gripping the bar. The tongue is positioned in front of an abutment surface having a fulcrum at an upper end. To release the latch, a distal end of the tongue must be flexed about the fulcrum of the abutment. This simultaneously retracts the upper pawl projection to allow the bar to move thereby and retracts the lower pawl projection below to provide access to the bar for gripping to pivot the cap open. The tongue and bar may be provided with a snap arrangement to provide an initial resistance to flexing the distal end of the tongue. The tongue is preferably hinged to the container and is pivotable between an upstanding child resistant position and a downwardly pivoted position to allow easy opening by an adult. The cap fits snugly on a neck of the container to allow sealing the container without latching the cap.

The hinge connecting the cap to the container is captive in a closed position and separable when the cap is pivoted to open the container. This allows the cap to be manufactured separately from the container such that a single cap configuration is usuable with a variety of sizes of containers which economizes manufacturing costs. The preferred container has a hinge pivot bar on an opposite side from the tongue. The cap is provided with a half cylindrical hook member which is open on a top side. The hook is snapped around the pivot bar with the cap positioned in an inverted orientation, and the hook pivots about the pivot bar toward a closed position. In the closed position, the manner of engagement between the hook and pivot bar prevents the hook from being separated from the pivot bar.

The periphery of the container extending on both sides between the latch structure and the hinge structure is configured to inhibit prying access to the cap. A peripheral shoulder extends about the neck of the container and is engaged by a depending cylindrical rim of the cap when closed. The shoulder extends radially outward past the thickness of the rim to make prying access to the rim of the cap difficult. A circumferential bead or wall may be provided on the shoulder to shield the interface between the cap rim and the shoulder. Alternatively, a reverse draft arrangement may be provided in which an upper surface of the shoulder is conical in an upwardly diverging manner, and a lower surface of the rim is similarly conical to cooperate with the shape of the shoulder conical surface.

OBJECTS OF THE INVENTION

The principal objects of the present invention are: to provide a improved child resistant container; to provide such a container which has an alternative easy open configuration for use by adults in circumstances not requiring resistance to tampering by young children; to provide such a container including a latch tongue having pawl projections defining a latch recess to flushly receive a latch bar of a container cap in which gripping access to the bar is inhibited by the flush fit of the bar in the recess; to provide such a container in which the latch bar is released from the tongue and made accessible for gripping access to open the cap by flexure of the tongue about a fulcrum end of an abutment behind the tongue; to provide such a container including a snap arrangement on the bar and tongue which provides an initial resistance to flexure of the tongue; to provide such a container in which the tongue is hinged to the container and positionable in a downwardly and outwardly extending easy to open configuration which avoids use of the latch in a circumstance in which the user is unable to use the latch because of a lack of manual dexterity or in a circumstance in which child resistance is not required; to provide such a container in which the cap is manufactured separately from the container and hinged to the container in such a manner that the hinge components are separable when the cap is opened fully from the container but is inseparable when the cap is closed; to provide such a container including a peripheral shoulder for engagement by a depending rim of the cap when closed, the shoulder extending radially past the thickness of the cap rim; to provide such a container including a peripheral bead or wall on an outer periphery of the shoulder which shields an interface between the cap rim and container shoulder to inhibit prying access to the rim of the cap; to provide an alternative embodiment of such a container in which interfacing surfaces of the shoulder and rim are frustoconical in shape to inhibit prying access to the rim of the cap; to provide such a flush latch mechanism in which the locations of the latch tongue and bar may be reversed, with the latch tongue on a closure member and the latch bar on the container; to provide such a latch mechanism which is applicable to a variety of types and sizes of containers other than containers intended to receive pharmaceuticals; and to provide such a flush latched child resistant container which is economical to manufacture, effective in operation, and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
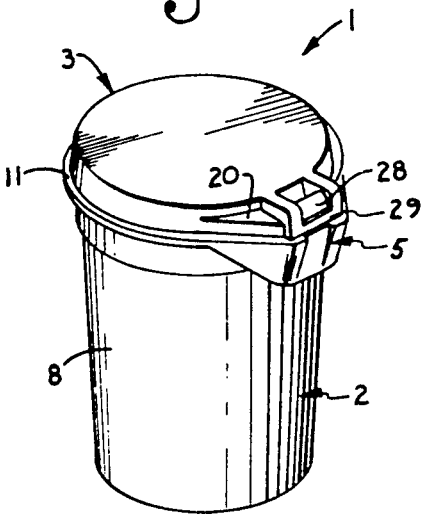
FIG. 1 is a perspective view of a child resistant container with flush latched closure embodying the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates a child resistant container assembly with a flush latched closure embodying the present invention. The container 1 generally includes a container body 2, a container closure or cap 3, a hinge mechanism 4 pivotally connecting the cap 3 to the body 2, and a flush latch structure 5 which is configurable to a child resistant position to secure the cap 3 in a closed position. The latch structure 5 is alternatively configurable to an easy open position to allow convenient use of the container 1 by persons having reduced manual dexterity or in circumstances in which a child resistance is not required. As will be detailed below, in the child resistant configuration of the latch structure 5, all edge portions of the cap 3 are recessed within an outer perimeter of the container body 2 to inhibit prying access to the cap 3, as by a fingernail, tooth, or the like to make it more difficult for young children not capable of reading to open the container 1.

The illustrated container body 2 is a vial-like structure suitable for dispensing prescription drugs, such as capsules, tablets, and the like. The container body 2 is formed by a steep conical side wall 8 converging toward a container bottom wall 9. A neck 10 of the container body 2 is ringed by a radially outwardly extending peripheral ledge or shoulder 11. The shoulder 11 extends around the neck 10 between a trapezoidal hinge base 12 on one side of the container body 2 and a trapezoidal base 13 on the opposite side of the body 2. The container body 2 may be formed from any suitable material and, particularly for pharmacy use, is preferably of a somewhat flexible and somewhat transparent plastic. Although the container body 2 is shown herein as a pharmacy type vial, it is foreseen that the container body 2 could be embodied as any of many different kinds of structures, such as squeeze tubes, liquid dispensing bottles, certain types of aerosol containers, glass bottles, or the like.

Figure 3:
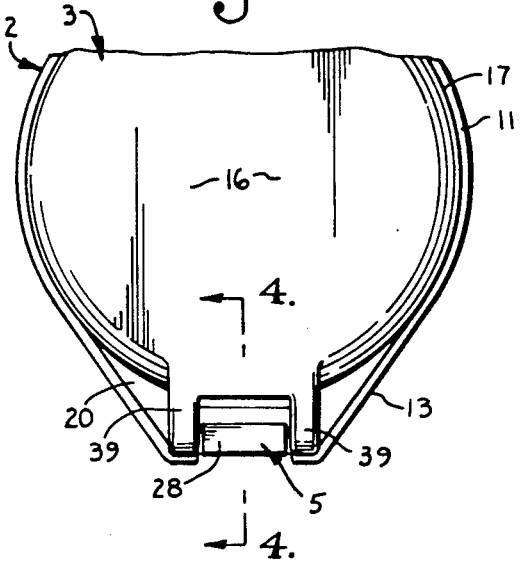
FIG. 3 is an enlarged fragmentary top plan view of the container with the cap shown in a closed position.

The illustrated closure member or cap 3 includes a top wall 16 with a cylindrical side wall 17 depending peripherally from the top wall 16. The side wall 17 is sized to fit snugly over the neck 10 of the container body 2 with a lower edge or rim 18 of the side wall 17 engaging the shoulder 11 of the container body 2. By this means, the container 1 is adapted to seal contents therein merely by closing the cap 3 onto the container body 2. As best viewed in FIG. 3, the thickness of the side wall 17 is such that the shoulder 11 extends radially outward of the side wall 17 to inhibit prying access to the rim 18 of the cap 3 to make the insertion of a fingernail or tooth between the rim 18 and the shoulder 11 difficult. A substantially trapezoidal hinge support 19 is formed on one side of the cap 3 and a similarly shaped latch support 20 is formed on the opposite side of the cap 3. The cap 3 may be formed of a material similar to that of the container body 2.

The hinge mechanism 4 is preferably configured to allow separation of the cap 3 from the container body 2 only when the cap 3 is opened and to prevent such separation when the cap 3 is closed. Separability of the cap 3 allows it to be manufactured separately from the container body 2 which simplifies the manufacturing mold for the body 2 and allows a single sized cap 3 to be usable with a variety of sizes of the container bodies 2. This simplifies and, thus, economizes the cost of manufacturing molds for various embodiments of the container 1.

Figure 6:
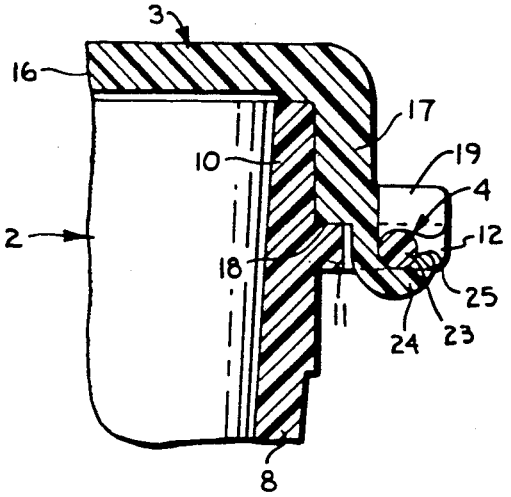
FIG. 6 is a greatly enlarged fragmentary sectional view illustrating cooperating parts of a hinge mechanism connecting the cap to the container body.

Referring to FIG. 6, the hinge mechanism 4 is formed by a hinge pin 23 supported between portions of the container body hinge base 12 and a hinge hook 24 supported by the hinge support 19 of the cap 3. The hinge hook 24 is a segment of a cylinder which is open on one side to receive the hinge pin 23 therethrough. The hinge pin 23 is snapped between the hinge hook 24 and an outwardly extending portion of the hinge support 19 of the cap 3. As shown in FIG. 6, because the hook 24 extends about a lower side of the hinge pin 23, it is impossible to separate the portions of the hinge mechanism 4 when the cap 3 is closed. However, as the cap 3 is pivoted to an open position, an opening 25 between an end of the hook 24 and the extending portions of the hinge support 19 is pivoted downward, allowing the hook 24 to be snapped free of the pin 23. Assembly of the cap 3 onto the container body 2 is accomplished by a reverse process.

Figure 4:
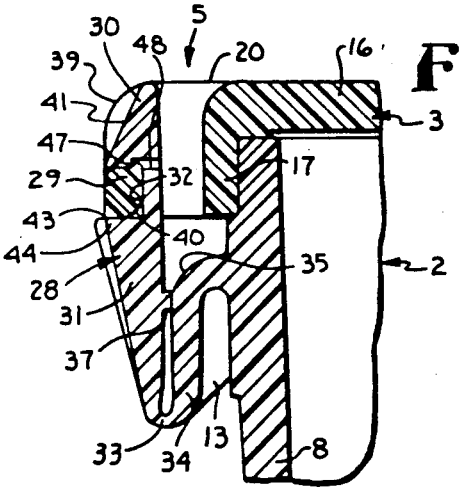
FIG. 4 is a greatly enlarged fragmentary sectional view taken on line 4—4 of FIG. 3 and illustrates details of a child resistant flush latch structure of the container.
Figure 5:
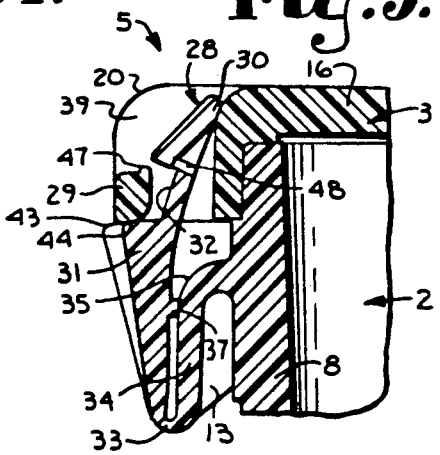
FIG. 5 is a view similar to FIG. 4 and illustrates a latch tongue of the latch structure in position to release the latch and provide gripping access to a latch bar of the container cap.
Figure 7:
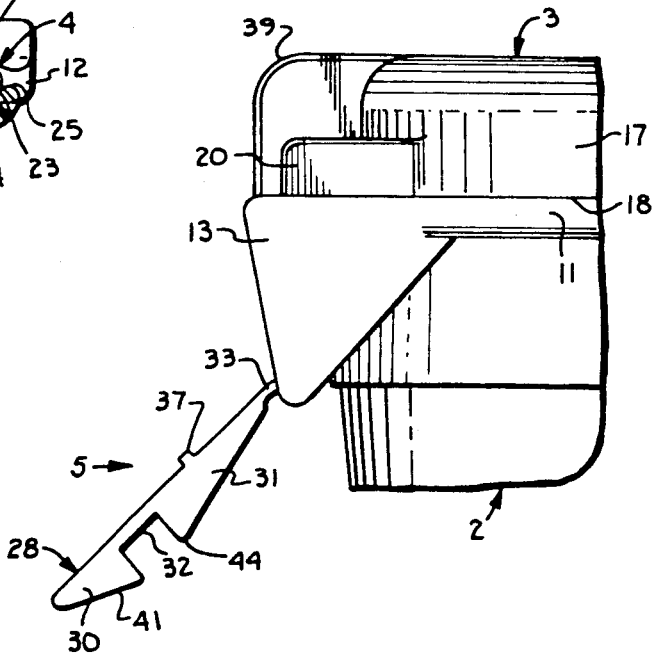
FIG. 7 is a greatly enlarged fragmentary side elevational view of the container with the tongue latch shown in an easy open configuration of the latch structure.

Referring to FIGS. 4, 5, and 7, the illustrated flush latch structure 5 includes a latch tongue 28 mounted on the container body 2 and cooperates with a latch bar 29 formed on the cap 3. The latch tongue 28 is a flat elongated member which is integrally hinged to and recessed within the latch base 13. The tongue 28 includes an upper pawl 30 and a somewhat similar lower wedge like formation or lower pawl 31 separated by a latch bar receiving recess or notch 32 extending across the tongue 28. A hinge membrane 33 connects the lower pawl 31 to an abutment wall or abutment 34 having an upper fulcrum end 35 which may connect with the container side wall 8. A rear surface of the lower pawl 32 may directly contact the abutment 34 or, as illustrated, a bumper ridge 37 may extend across the rear surface of the lower pawl 32 at a position to contact the fulcrum end 35 of the abutment 34. The flexibility of the tongue 28 and contact between the ridge 37 and the fulcrum end 35 urges the tongue 28 in an outward direction. The entire tongue 28 is flexible, but the reduced wall thickness in the area of the recess 32 causes this region to be particularly flexible.

Figure 2:
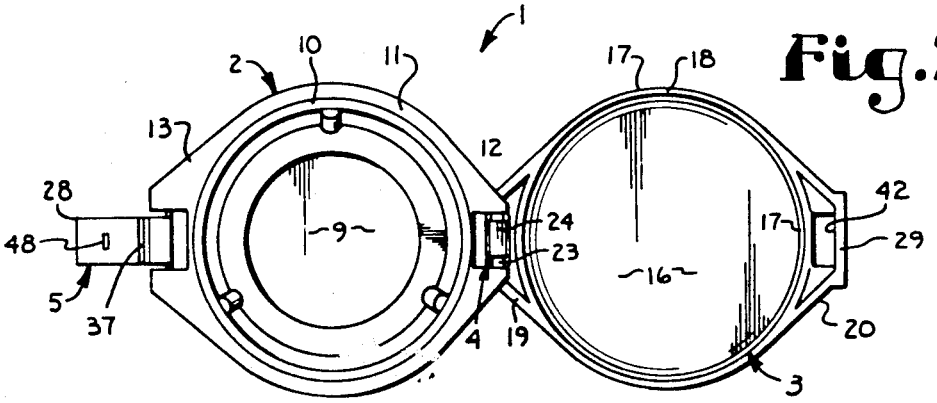
FIG. 2 is a top plan view of the container with a cap shown in an open position.

The latch bar 29 extends between a pair of spaced apart latch shields 39 forming a part of the latch support 20. The bar 29 is generally of a rectangular cross section except for a lower rear cam surface 40 which is adapted to cooperate with an upper front angled surface 41 of the upper pawl 30 of the tongue 28. The bar 29 is spaced from the cap side wall 17 to form a latch tongue receiving aperture 42 (FIG. 2) therebetween. The bar 29 includes a lower front gripping edge 43 (FIG. 5). The latch bar 29 and the recess 32 are cooperatively sized to receive the bar entirely and flushly within the recess 32.

As shown in FIG. 4, when the tongue 28 is in the child resistant configuration, the gripping edge 43 of the bar 29 is substantially flush with an upper and outer shield edge 44 of the lower pawl 31 of the tongue 28. The gripping edge 43 is, thus, inaccessible for gripping. Additionally, the rim 18 of the side wall 17 of the cap 3 is made inaccessible by the shoulder 11, and the hinge hook 24 is positioned about the lower side of the hinge pin 23. In the child resistant configuration, the container 1 is very difficult to open in an unintended manner, such as by young children using their fingernails or teeth. In order to release the latch structure 5 to open the cap 3 from the container body 2, the upper pawl 30 of the latch tongue 28 must be flexed away from the latch bar 29 toward the cap 3 (see FIG. 5). Preferably, instructions for opening the container 1 are embossed or printed on the cap 3, container body 2, or on a label thereon.

Flexure of the latch tongue 28 moves the upper pawl 30 out of the way of the latch bar 29 to allow it to be moved thereby. Additionally, flexure of the upper pawl 30 causes a slight flexure of the lower pawl 31 which in turn moves the shield edge 44 thereof underneath the latch bar 29 thereby exposing the gripping edge 43 of the bar 29. The cap 3 may now be opened by gripping the edge 43 with a fingernail, fingertip, or the like and pivoting the cap 3 about the hinge mechanism 4. The latch structure 5 may be provided with a snap arrangement to provide an initial resistance to flexure of the latch tongue 28. As illustrated, the latch bar 29 is provided with a small snap bump 47, and the tongue 28 has a snap slot 48 formed thereto which intersects the latch recess 32. Alternatively, other types of snap arrangements may be provided.

The container 1 may be closed into the child resistant configuration by placing the latch tongue 28 in an upstanding position relative to the container body 2, and merely closing the cap 3 onto the container body 2. Upon pivoting the cap 3 closed, the upper pawl 30 is received through the latch aperture 42, and the latch bar 29 snaps past the upper pawl 30 into the recess 32. If a child resistant container is not required, the container 1 may also be closed into an easy-to-open configuration by pivoting the latch tongue 28 forward from the container body 2 (see FIG. 7) and pivoting the cap 3 to engage the rim 18 with the shoulder 11. The gripping edge 43 of the latch bar 29, and the entire lower surface of the latch bar 29, is now accessible for opening the cap 3 using a fingertip since the latch tongue 2B does not interfere. For convenience, the latch tongue 2 may be removed, as by tearing or cutting the latch tongue hinge membrane 33, if a child resistant configuration of the container 1 will not subsequently be needed.

Figure 8:
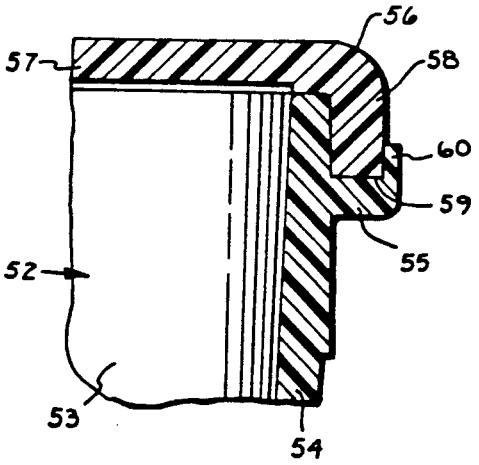
FIG. 8 is an enlarged fragmentary radial sectional view of a modified embodiment of the container and illustrates a peripheral wall preventing prying access to an interface between a cap rim and a container body shoulder.

FIG. 8 illustrates a first modified embodiment of a container according to the present invention. The first modified container 52 includes a container body 53 including a conical container body wall 54 with a shoulder 55 extending circumferentially about the wall 54. The container 52 includes a closure or cap 56 substantially similar to the cap 3 of the container 1 and including a top wall 57 and a cylindrical side wall 58 depending therefrom. The side wall 58 terminates in a peripheral rim 59. The container body 53 is substantially similar to the container body 2 except that the shoulder 55 is provided with an upstanding bead or wall 60 which positively prevents prying access to an interface between the upper surface of the shoulder 55 and the rim 59 of the cap 56. The container 52 preferably also includes a flush latch structure (not shown) similar in construction and operation to the latch structure 5 and a hinge mechanism (not shown) similar to the hinge mechanism 4 of the container 1.

Figure 9:
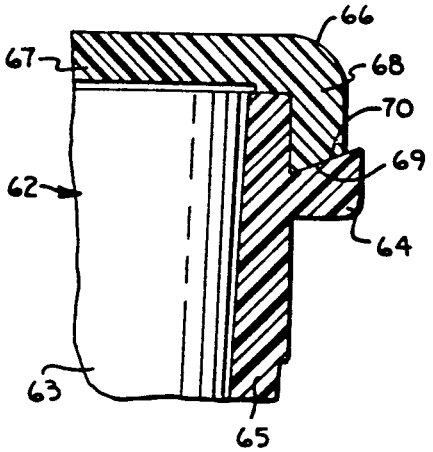
FIG. 9 is a view similar to FIG. 8 of a second modified embodiment of the container and illustrates cooperating conical surfaces of the cap rim and container body shoulder.

FIG. 9 illustrates a second modified embodiment of the container according to the present invention. The second modified container 62 includes a container body 63 with a shoulder 64 formed circumferentially about a container side wall 65. A cap 66 includes a top wall 67 with a cylindrical side wall 68 depending therefrom and terminating in a cap rim 69. The shoulder 64 has a frustoconical upper surface 70, and the cap rim 69 is cooperatively frustoconically shaped. The conically shaped rim 69 and upper surface 70 cooperate to inhibit prying access therebetween by a young child using a fingernail or tooth to attempt to open the container 62. In all other respects, the container 62 is substantially similar to the containers 1 and 52.

It is to be understood that while certain forms of the present invention have been illustrated and described herein, it is not to be limited to the specific forms or arrangement of parts described and shown.

What is claimed and desired to be secured by Letters Patent is as follows:

1. A child resistant latch mechanism for removably latching a closure member hinged to a container body and comprising:

(a) a resilient and elongate latch tongue including pawl means forming a recess thereacross;

(b) a bar sized and shaped to be received substantially entirely and flushly within said recess;

(c) said bar being positioned on one of said closure member or said container body and in spaced relation thereto; and (d) said tongue being connected at a first and thereof to the other of said closure member on said container body and having a distal second end opposite said first end; said tongue being flexible between said first and second ends and said recess being located between and in spaced relationship to both of said first and second tongue ends, such that when said bar is positioned in said recess said closure member is latched to said container body inhibiting grasping access to said bar for aid in opening said closure member and said tongue distal second end is exposed to direct manual manipulation by a user; said tongue being engageable by a user and flexed by direct manipulating away from said bar when said bar is positioned in said recess so as to expose said bar to direct manipulation by a user and so as to release said pawl means therefrom to enable a user to thereafter separate said tongue from said bar and open said closure member.

2. A mechanism as set forth in claim 1 and including:

(a) said closure member having a depending peripheral rim;

(b) said container body having a peripheral shoulder engaged by said rim when said closure member is closed upon said container body; and (c) said rim and said shoulder being cooperatively configured to inhibit prying access to said rim to thereby release said closure member from said container.

3. A mechanism as set forth in claim 1 and including:

(a) hinge means pivotally connecting said closure member to said container body, said hinge means being configured to inhibit separation of said closure member from said container body when said closure member is closed upon said container body and to allow separation of said closure member from said container body when said closure member is pivoted open from said container body.

4. A mechanism as set forth in claim 1 wherein:

(a) said tongue is positioned on said other of said closure member or said container member by pivotally mounting said tongue thereto; said tongue is selectively positionable in a child resistant position to engage said recess with said bar upon closure of said closure member or an easy open position to avoid engagement between said recess and said bar upon closure of said closure member.

5. A child resistant container comprising:

(a) a container body;

(b) a closure member hingedly connected to said container body;

(c) an abutment formed on said container body, said abutment terminating in a fulcrum end;

(d) a latch tongue connected at one end to said container body, being positioned in covering relation to said abutment, and extending past said fulcrum end, an opposite distal end of said tongue being flexible about said fulcrum end;

(e) pawl means positioned on said tongue and forming a latch recess across said tongue, said recess being positioned in spaced relation to said fulcrum end;

(f) a latch bar positioned on said closure member and forming a pawl receiving aperture therewith, said bar being sized and shaped to be received entirely and flushly within said recess; and (g) a portion of said pawl means being received through said aperture and said bar being positioned in said recess to latch said closure member closed upon said container body, whereby grasping access to said bar to open said closure member is inhibited by said bar being flushly positioned in said recess and whereby flexure of said distal end about said fulcrum end releases said pawl means from said bar and exposes said bar for grasping access to thereby enable said closure member to be opened from said container body.

6. A container as set forth in claim 5 and including:

(a) said closure member having a depending peripheral rim;

(b) said container body having a peripheral shoulder engaged by said rim when said closure member is closed upon said container body; and (c) said rim and said shoulder being cooperatively configured to inhibit prying access to said rim to thereby release said closure member from said container.

7. A container as set forth in claim 6 wherein:

(a) said shoulder extends radially outward of said rim.

8. A container as set forth in claim 6 wherein:

(a) said shoulder includes an annular surface extending radially outward of said rim; and (b) an outer periphery of said surface includes bead means extending circumferentially therealong which inhibits said prying access to said rim.

9. A container as set forth in claim 6 wherein;

(a) said container includes an open mouth covered by said closure member when closed;

(b) said shoulder includes a circumferential conical shoulder surface forming an acute angle with said container body which is open toward said mouth; and (c) said rim includes a circumferential conical rim surface which mates with said shoulder surface when said closure member is closed to thereby inhibit said prying access to said rim.

10. A container as set forth in claim 5 and including:

(a) hinge means pivotally connecting said closure member to said container body, said hinge means being configured to inhibit separation of said closure member from said container body when said closure member is closed upon said container body and to allow separation of said closure member from said container body when said closure member is pivoted open from said container body.

11. A container as set forth in claim 10 wherein:

(a) one of said container body or said closure member has a pivot bar positioned thereon in spaced relation thereto; and (b) the other of said said container body or said closure member includes a hinge hook which is open on one side and which engages said pivot bar to form a closure member hinge, said hinge bar and hinge hook cooperating to inhibit separation of said hinge hook from said pivot bar when said closure member is closed upon said container body and enabling separation of said hinge hook from said hinge bar when said closure member is opened.

12. A container as set forth in claim 5 wherein:

(a) said latch tongue is connected at one end to said container body by pivotally mounting said latch tongue thereto; said latch tongue is selectively positionable in a child resistant position to engage said recess with said bar upon closure of said closure member or an easy open position to avoid engagement between said recess and said bar upon closure of said closure member.

13. A container as set forth in claim 5 and including:

(a) snap means engaging said tongue when said bar is received in said recess, said snap means initially inhibiting flexure of said distal end of said tongue.

14. A child resistant container comprising:

(a) a container body;

(b) a closure member;

(c) hinge means pivotally connecting said closure member to said container body, said hinge means being configured to inhibit separation of said closure member from said container body when said closure member is closed upon said container body and to allow separation of said closure member from said container body when said closure member is pivoted open from said container body;

(d) said closure member having a depending peripheral rim, said container body having a peripheral shoulder engaged by said rim when said closure member is closed upon said container body, and said rim and said shoulder being cooperatively configured to inhibit prying access to said rim to thereby release said closure member from said container;

(e) an abutment formed on said container body, said abutment terminating in a fulcrum end;

(f) a latch tongue connected at one end to said container body, being positioned in covering relation to said abutment, and extending past said fulcrum end, an opposite distal end of said tongue being flexible about said fulcrum end;

(g) pawl means positioned on said tongue and forming a latch recess across said tongue, said recess being positioned in spaced relation to said fulcrum end;

(h) a latch bar positioned on said closure member and forming a pawl receiving aperture therewith, said bar being sized and shaped to be received entirely and flushly within said recess; and (i) a portion of said pawl means being received through said aperture and said bar being positioned in said recess to latch said closure member closed upon said container body, whereby grasping access to said bar to open said closure member is inhibited by said bar being flushly positioned in said recess and whereby flexure of said distal end about said fulcrum end releases said pawl means from said bar and exposes said bar for grasping access to thereby enable said closure member to be opened from said container body.

15. A container as set forth in claim 14 wherein:

(a) said shoulder extends radially outward of said rim.

16. A container as set forth in claim 14 wherein:

(a) said shoulder includes an annular surface extending radially outward of said rim; and (b) an outer periphery of said surface includes bead means extending circumferentially therealong which inhibits said prying access to said rim.

17. A container as set forth in claim 14 wherein;

(a) said container includes an open mouth covered by said closure member when closed;

(b) said shoulder includes a circumferential conical shoulder surface forming an acute angle with said container body which is open toward said mouth; and (c) said rim includes a circumferential conical rim surface which mates with said shoulder surface when said closure member is closed to thereby inhibit said prying access to said rim.

18. A container as set forth in claim 14 wherein:

(a) said container body or said closure member has a pivot bar positioned thereon in spaced relation thereto; and (b) said closure member includes a hinge hook which is open on one side and which engages said pivot bar to form a closure member hinge, said hinge bar and hinge hook cooperating to inhibit separation of said hinge hook from said pivot bar when said closure member is closed upon said container body and enabling separation of said hinge hook from said hinge bar when said closure member is opened.

19. A container as set forth in claim 14 wherein:

(a) said latch tongue is connected at one end to said container body by pivotally mounting said latch tongue thereto; said latch tongue is selectively positionable in a child resistant position to engage said recess with said bar upon closure of said closure member or an easy open position to avoid engagement between said recess and said bar upon closure of said closure member.

20. A container as set forth in claim 14 and including:

(a) bump means formed on one of said bar or said pawl means;

(b) a bump receiving cavity formed on the other of said bar or said pawl means, receiving said bump means when said bar is received in said recess, and cooperating therewith to initially inhibit flexure of said distal end of said tongue.

* * * * *